US005188892A

United States Patent [19]

Grindstaff

[11] Patent Number: 5,188,892

[45] Date of Patent: Feb. 23, 1993

[54] SPUN TEXTILE YARNS

[75] Inventor: Teddy H. Grindstaff, Charleston, W. Va.

[73] Assignee: E. I. Du Pont de Nemours and Company, Wilmington, Del.

[21] Appl. No.: 857,175

[22] Filed: Mar. 25, 1992

Related U.S. Application Data

[60] Continuation-in-part of Ser. No. 758,426, Sep. 3, 1991, abandoned, and a continuation of Ser. No. 368,844, Jun. 20, 1989, abandoned, and a continuation-in-part of Ser. No. 266,712, Nov. 3, 1988, abandoned, and a continuation-in-part of Ser. No. 212,301, Jun. 27, 1988, abandoned, Division of Ser. No. 925,640, Oct. 13, 1986, abandoned, and a continuation-in-part of Ser. No. 794,128, Oct. 15, 1991, and a continuation-in-part of Ser. No. 607,208, Oct. 31, 1990, abandoned, and a continuation-in-part of Ser. No. 266,712, Nov. 3, 1988, abandoned, and a continuation-in-part of Ser. No. 925,640, Oct. 31, 1986, abandoned.

[51] Int. Cl.[5] ..... D02G 3/00

[52] U.S. Cl. ..... 428/59; 57/252; 57/254; 57/253; 57/255; 428/362; 428/370; 428/399; 428/397; 428/401

[58] Field of Search ..... 57/252, 254, 253, 255; 428/359, 362, 370, 399, 400, 397, 401

[56] References Cited

U.S. PATENT DOCUMENTS

| | | | |
|---|---|---|---|
| 2,172,439 | 9/1939 | Dreyfus et al. | 57/140 |
| 2,964,900 | 12/1960 | Hicks | 57/140 |
| 2,980,492 | 4/1961 | Jamieson et al. | 18/54 |
| 3,046,724 | 7/1962 | Ward | 57/140 |
| 3,604,197 | 9/1971 | Sekiguchi et al. | 57/140 |
| 3,965,664 | 6/1976 | Goetti et al. | 57/157 R |
| 4,156,071 | 5/1979 | Knox | 57/246 |
| 4,384,450 | 5/1983 | Sawyer | 57/254 |
| 4,477,515 | 10/1984 | Masuda et al. | 52/428 |

FOREIGN PATENT DOCUMENTS 2039560 1/1983 United Kingdom .

OTHER PUBLICATIONS

Textile Progress, vol. 14, No. 3/4 (1986) pp. 14–16 "Yarn Evenness" by K. Slater.

J. Textile Institute, vol. 49 (1958) pp. 418–434–"Engineering of Fabrics From Blends with Synthetic Fibers" by R. M. Hoffman & R. W. Peterson.

*Primary Examiner*—Patrick J. Ryan
*Assistant Examiner*—N. Edwel

[57] ABSTRACT

Spun textile yarns from new polyester staple fiber, and downstream textile articles, such as fabrics and garments, made from such, and blends thereof, wherein the staple fiber is of intentionally mixed denier, the higher denier being about twice the lower denier. Such staple fiber and precursor tows are preferably made by spinning filaments of different deniers, and collecting them in the same filament bundle on the same spinning machine, from orifices/capillaries of different diameters and/or throughputs.

6 Claims, 6 Drawing Sheets

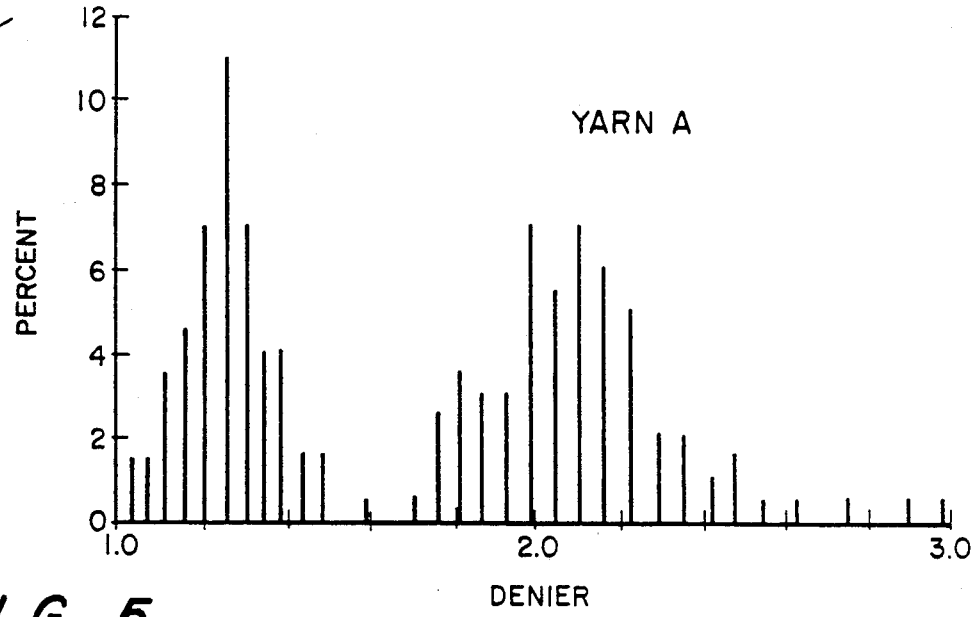
FIG. 5
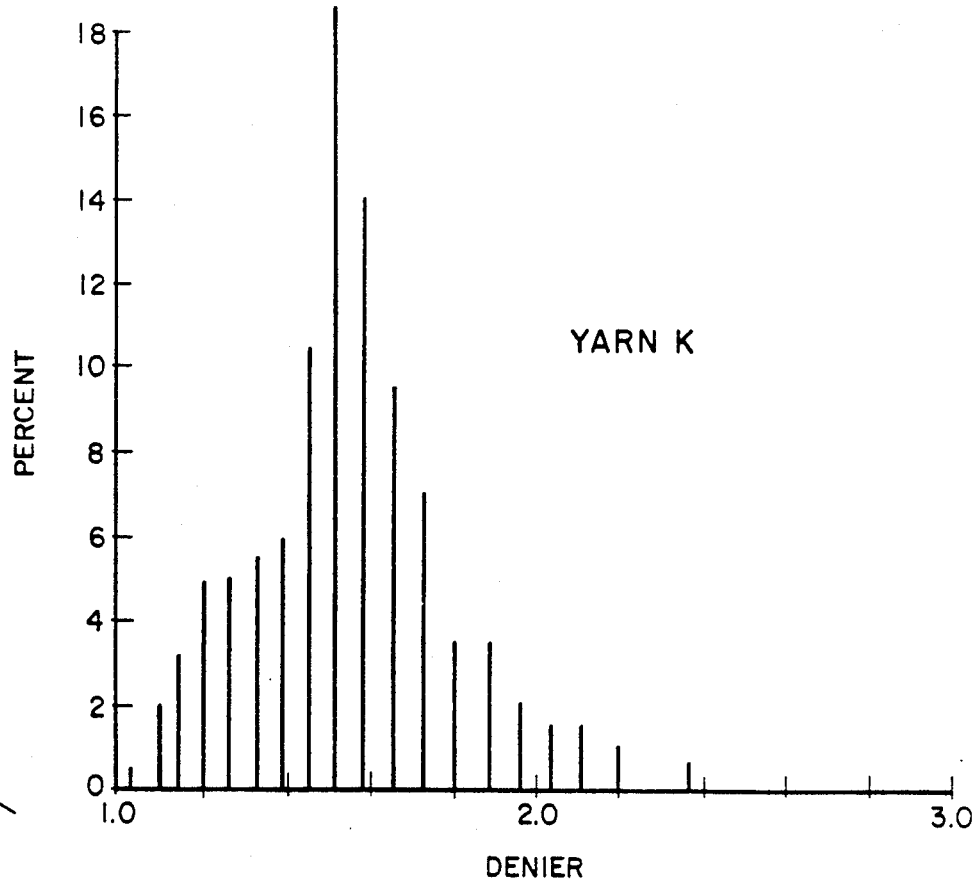

SPUN TEXTILE YARNS

CROSS-REFERENCE TO RELATED APPLICATIONS

This application is a continuation-in-part of my previous applications, as follows: application Ser. No. 07/758,426, filed Sep. 3, 1991, is now abandoned itself a continuation of application Ser. No. 07/368,844, filed Jun. 20, 1989, is now abandoned itself a continuation-in-part of application Ser. No. 07/266,712 is now abandoned and a continuation-in-part of application Ser. No. 07/212,301, filed Jun. 27, 1988, is now abandoned being a divisional of original application Ser. No. 06/925,640, is now abandoned and also a continuation-in-part of application Ser. No. 07/794,128, filed Oct. 15, 1991, is now pending itself a continuation-in-part of application Ser. No. 07/607,208, filed Oct. 31, 1990, is now abandoned itself a continuation of application Ser. No. 07/266,712, filed Nov. 3, 1988, is now abandoned itself a continuation-in-part of the same original application Ser. No. 06/925,640, filed Oct. 31, 1986 is now abandoned.

TECHNICAL FIELD

This invention concerns improvements in and relating to textile staple fiber of the polyester type, such as is commonly referred to as polyester staple fiber, and including precursor polyester tows that are cut or otherwise converted to staple fiber, and to textile articles such as spun yarns prepared from such staple, and fabrics and garments containing such yarn or fiber, and to processes for obtaining the same.

BACKGROUND OF THE INVENTION

Synthetic polyester yarns have been known and used commercially for several decades, having been first suggested by W. H. Carothers, U.S. Pat. No. 2,071,251, and then by Whinfield and Dickson, U.S. Pat. No. 2,465,319. In particular, polyester staple fiber has been an industrial commodity that has been manufactured and used in spun textile yarns on a very large scale, primarily in blends with natural fibers, especially cotton, such blends having been spun (twisted) into spun yarns that have been made into textile fabrics, and eventually into garments and other textiles. A typical spun textile yarn is of cotton count 25, containing a cross-section of about 140 fibers of 1½ denier and 1½ inches cut length, for example, but the denier and cut length can vary up to about 3 and down to about 1. Because of the sophistication of the textile industry, both of the polyester fiber manufacturing industry and of downstream consumers of textiles, and because of the commercial interest in providing apparel and fabrics that will perform well during actual use by the ultimate consumer (wearer), much attention has been devoted to analyzing appropriate requirements. Many technical papers, for example, have been published on various aspects, and patents have been issued with the objective of improving the "comfort" that can be obtained from textile articles, and their constituents, and the literature has been replete with these suggestions for several years. So it has long been considered desirable to improve the comfort properties obtainable from textiles prepared from spun textile yarns of polyester staple fiber, and much effort has been devoted in the textile industry towards this objective.

There has also been increasing interest in providing polyester fiber of low shrinkage for making spun yarns. Low shrinkage means low and uniform shrinkage, especially to avoid high shrinkage tensions (such as occur usually with polyester fiber that has not been processed to reduce its shrinkage), to avoid problems subsequently, often referred to as downstream, during processing of the yarns or fabrics. Mixed shrinkage is not desired according to the present invention. Apart from other characteristics, the shrinkage of higher shrinkage components causes a tightening up that is not desired in yarns according to the present invention. The present application, therefore, concerns polyester fiber that is of desirably low and uniform boil-off shrinkage, preferably less than about 3%, and especially less than about 1%. The dry heat shrinkage, measured at 196° C., is preferably less than about 6%.

An important objective of my invention is to provide such polyester staple fiber in a new form and to process it into spun yarns, which can then be formed into fabrics and garments that can show improved comfort properties, as discussed hereinafter.

Polyester staple fiber of low shrinkage has generally been manufactured commercially by a process of melt spinning (i.e. extruding molten polyester polymer) into a bundle of filaments, collecting such filaments into a tow, which can be relatively small and converted directly, e.g. by stretch-breaking, into a spun yarn, but has more often been extremely large, amounting to many thousand and even some million(s) of filaments, and this tow has then been processed by drawing, treating to reduce shrinkage, and crimping, and the crimped low shrinkage filaments have been converted into staple fiber by cutting, or otherwise, to the desired lengths. As indicated, polyester staple fiber has often then been blended, e.g. with cotton, and converted into yarn, which is generally referred to as a spun yarn, to distinguish it from a continuous filament yarn. The natural fibers, such as cotton, with which the polyester staple has often been blended have not been uniform. For instance, they vary in size, shape and surface properties to some extent. The natural characteristics of cotton have long been believed to be responsible for the attractive qualities of the spun yarns, and of the articles, such as fabrics and garments, prepared therefrom, and much effort has been devoted to duplicating various characteristics of cotton. Nevertheless, so far as I know, polyester staple has been sold commercially as of uniform nominal denier (denier being the weight in grams of 9000 meters of a staple fiber, continuous filament or yarn, and thus being a measure in effect of the thickness of the fiber, filament or yarn; in fact, since staple fiber is, by definition, of short cut length, about 1 to 3 inches, the denier must be calculated by extrapolation or must be measured on the precursor tow or, more precisely, on random extracts of a specified number of continuous filaments from the tow). When one refers to uniform denier, the nominal denier, i.e. average denier, is referred to, since there is inevitable variation along-end and end-to-end. However for commodity fibers, as opposed to some specialty fibers, it has generally been the objective of fiber producers to achieve as much uniformity as possible when melt-spinning, drawing and reducing shrinkage and thus to minimize variations between individual filaments (i.e. end-to-end) and along the individual filaments (i.e. along-end), so as to produce a polyester fiber product of as uniform denier as practical. This is the present commercial practice. Polyester fiber producers sell tow or staple fiber of various nominal deniers. It would have been possible for anyone to buy polyester staple fiber (or tow) of various different deniers, and to blend them together, if desired with natural fibers, such as cotton. I do not know that anyone has actually done this, but it would have been quite possible. I believe that polyester staple fiber or tow of intentionally mixed denier has not previously been sold as an article of commerce. Polyester fiber is usually sold compressed into bales. I believe bales of polyester fiber of intentionally mixed denier have not previously been sold as articles of commerce.

The present invention is not concerned with continuous filament yarns, but with staple fiber for making spun yarns, which have entirely different aesthetics and are prepared by different techniques.

Wada et al., U.K. Patent Application GB 2 039 560A (Wada), concerns a multi-layered bulky spun yarn comprising at least three kinds of staple fibers which vary in denier. Wada mixes together fibers of different thermal shrinkage into a sliver which is wrapped around a roving of fibers of a third kind, to get a double layered roving, which is then spun into a fine spun yarn, which is subjected to heat treatment. This heat treatment causes layering of the different fibers, because of their different shrinkages, so that the heat-treated yarn has an outer layer of fiber of fine denier and a core of fibers of high denier, separated by an intermediate layer of fibers of intermediate denier, as shown in FIG. 1B of Wada, as contrasted with FIG. 1A, before heat treatment. As has been explained, mixed shrinkage is not desirable according to the present invention (nor is Wada's layering, as will be apparent).

Sekiguchi, U.S. Pat. No. 3,604,197 teaches multicolored yarns made from a blend of different denier fibers, preferably of differing shrinkages, so the higher deniers collect in the core, and the finer deniers emerge at the yarn surface. The present invention is not concerned with such multicolored yarns, but with polyester fibers of uniformly the same color or substantially the same color, as indicated herein.

SUMMARY OF THE INVENTION

According to the present invention, there are provided new intimately and randomly mixed blends, for instance in the form of spun textile yarns of such blends, of polyester staple fiber of low shrinkage, but with some of larger denier and other of smaller denier, the larger denier being about twice the smaller denier, and of cut length about 1 to about 3 inches and of average denier up to about 3. These spun yarns are prepared from new blends of such staple, optionally with other fibers, and may be processed into textile fabrics and garments consisting wholly or partially of such yarns. In other words, the yarns (and textiles therefrom) are characterized by the randomly mixed denier of the low shrinkage staple fiber, i.e. the polyester staple is intentionally not of uniform nominal denier, but is intentionally of different deniers, larger and smaller, randomly mixed together.

It is believed that it is this intentionally mixed denier of the staple fiber in the new articles of the invention that provides advantages over articles from the polyester staple that has been available heretofore commercially. Only comparisons in fabrics or garments are considered truly meaningful, and these will be discussed hereinafter.

Accordingly, there is provided, according to the invention, an intimate blend of polyester staple fiber of uniformly the same color, of boil off shrinkage about 1% or less, of uniform cut length about 1 to about 3 inches, and of average denier up to about 3, such as is suitable for spinning into spun yarn, wherein the blend consists essentially of polyester fiber of larger denier randomly and uniformly mixed with polyester fiber of smaller denier, the larger denier being about twice the smaller denier, and the degree of filament intermingling (DFI) being at least about 90%.

There also provided bales of such blended fiber.

There are also provided spun yarns consisting essentially of such a blend of intimately and randomly mixed polyester fibers of low shrinkage, and spun yarns consisting essentially of an intimately mixed blend of polyester staple fibers with fibers other than polyester fibers, especially cotton, wherein the polyester fibers are mixed as indicated.

As indicated in the Examples, the intimately mixed denier staple fiber (more precisely the precursor tows) were obtained by a preferred process of melt spinning filaments of mixed denier on the same spinning machine. In other words, filaments of different deniers were spun from the same spinning machine and were collected and mixed together in the same bundle, as contrasted with mixing separate batches of uniform fibers (i.e. of the same single denier) made by spinning on different machines and collecting into separate bundles and processing separately before they are subsequently mixed. Thus the polyester, despite being of different deniers, is otherwise similar, e.g. in color, and may be cut to a uniform length of staple.

Accordingly, there is provided also, according to the invention, a process for preparing a blend of polyester staple fiber of low shrinkage and of intentionally different deniers, wherein a bundle of filaments of deniers that differ by the desired ratio is prepared by spinning through capillaries of differing size and/or throughput on the same spinning machine, and these filaments of different deniers are collected together in the same bundle, and such bundles are processed to reduce the filament shrinkage, and are then converted into staple fiber. According to present conventional technology for preparing polyester staple fibers, generally several such bundles will be collected together and subjected to the steps of drawing, and annealing, before crimping and conversion to staple fiber. However, it has been suggested and is known to be possible to prepare polyester filaments directly by winding at high speeds (of the order of several km/min.) and thereby avoid the need for a separate drawing step. As explained, however, the filaments are preferably mixed by initially spinning the filaments of different deniers on the same spinning machine, than by spinning separately filaments of the same single denier followed by later mixing cut fibers of different deniers. Furthermore, although this is not yet certain, there may be attendant advantages in the properties of the actual filaments by cospinning the same bundle in the same cell or spinning position through capillaries of different diameters and/or throughput, and advancing this bundle of intimately mixed filaments of different deniers together from the same cell.

Accordingly, there is also provided, according to the present invention, a process for preparing a blend of polyester staple fiber of low shrinkage and of intentionally different deniers, wherein bundles of filaments of deniers that differ by the desired ratio are prepared by cospinning each bundle from the same spinneret through capillaries of differing size and/or throughput at the same spinning position, whereby these filaments of different deniers are collected and mixed together in the same bundle, and such bundles are processed to reduce the filament shrinkage, and then converted into staple fiber.

The precursor polyester tows of intimately mixed filaments of different deniers are also believed new, as are the processes for their preparation. Accordingly, there is also provided, according to the present invention, a process for preparing a tow of polyester filaments for conversion into polyester staple fiber, wherein the tow is a mixture of polyester filaments of different deniers, such process comprising the step of forming bundles of filaments of deniers that differ by the desired ratio by spinning through capillaries of differing size and/or throughput on the same spinning machine, and such filaments of different denier are collected together in the same bundle, optionally combining together such bundles into a larger tow, and optionally subjecting the filaments to drawing, annealing and/or crimping operations in the form of such tow.

Furthermore, there is provided a process for preparing a tow of polyester filaments for conversion into polyester staple fiber, wherein the tow is a mixture of polyester filaments of different deniers, such process comprising the step of forming bundles of filaments of denier that differ by the desired ratio by cospinning each bundle from the same spinneret through capillaries of differing size and/or throughput into the same spinning position, whereby such filaments of different denier are collected and mixed together in the same bundle, optionally combining together such bundles into a larger tow, and optionally subjecting the filaments to drawing, annealing and/or crimping operations in the form of such tow.

I believe that the new textile yarns, fabrics and garments containing polyester staple of low shrinkage and of mixed denier that I refer to herein, according to the invention, provide advantages and improvements in comparison with prior art polyester articles that were similar, but of as uniform denier as possible.

BRIEF DESCRIPTION OF DRAWINGS

FIG. 5 shows denier histograms for yarns, as explained hereinafter.

DETAILED DESCRIPTION OF INVENTION

Figure 1:
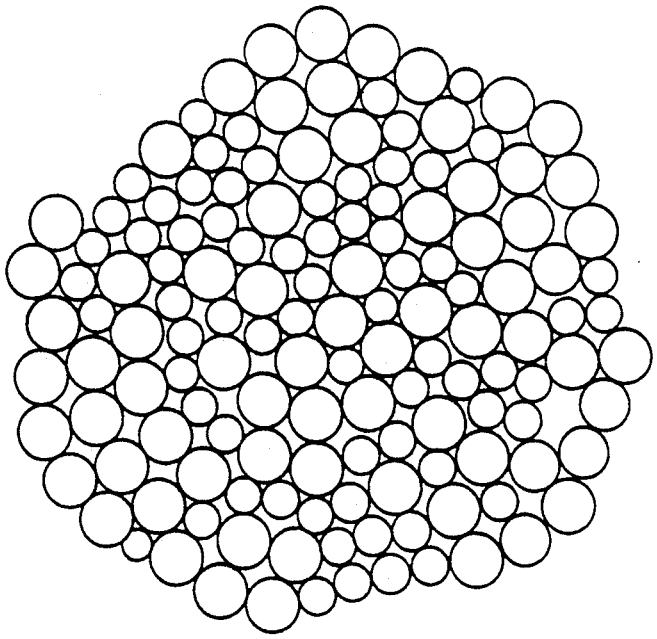
FIGS. 1 and 2 show, in cross-section, assemblies of some 140 fibers to demonstrate the difference between how the fibers pack together in a mixed denier yarn in contrast to a uniform denier yarn, as explained hereinafter.
Figure 2:
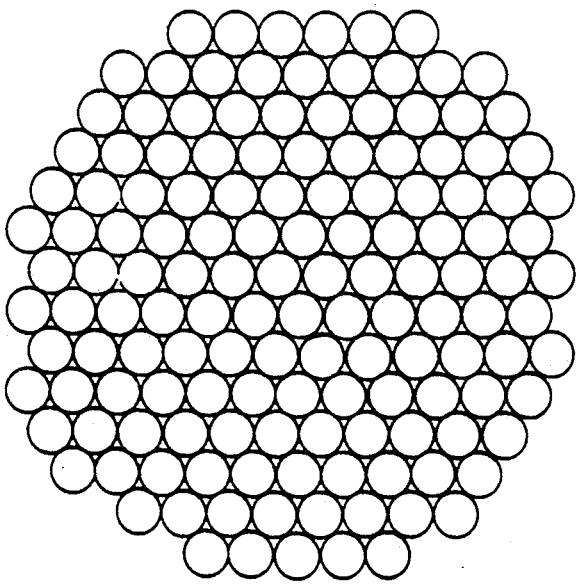

Assemblies of 140 fibers are shown as circles in FIGS. 1 and 2, to represent schematically the difference between the packing together of fibers in a spun yarn consisting of an intimate mixture of fibers of two different deniers, i.e. according to the invention, as shown in cross-section in FIG. 1, and a similar assembly but of uniform denier, as shown in cross-section in FIG. 2, i.e. according to the prior art. It will be noted that, in FIG. 2, the filaments of uniform denier are closely packed, and that this does not permit much space between the filaments. In contrast, in FIG. 1, despite the random arrangement (i.e. the filaments are not arranged in a uniformly alternating pattern), significantly larger spaces are provided between the filaments. I believe that this may be a significant factor in increasing the comfort of fabrics and garments incorporating polyester fibers of mixed denier according to the present invention, although this may not explain all the advantages of the invention, as will be apparent, hereinafter.

It will also readily be understood why the use of high shrinkage polyester staple is not desired, because the greater the shrinkage the more closely the shrunk fibers will tend to pack, especially if the shrinkage tension is high.

Figure 6:
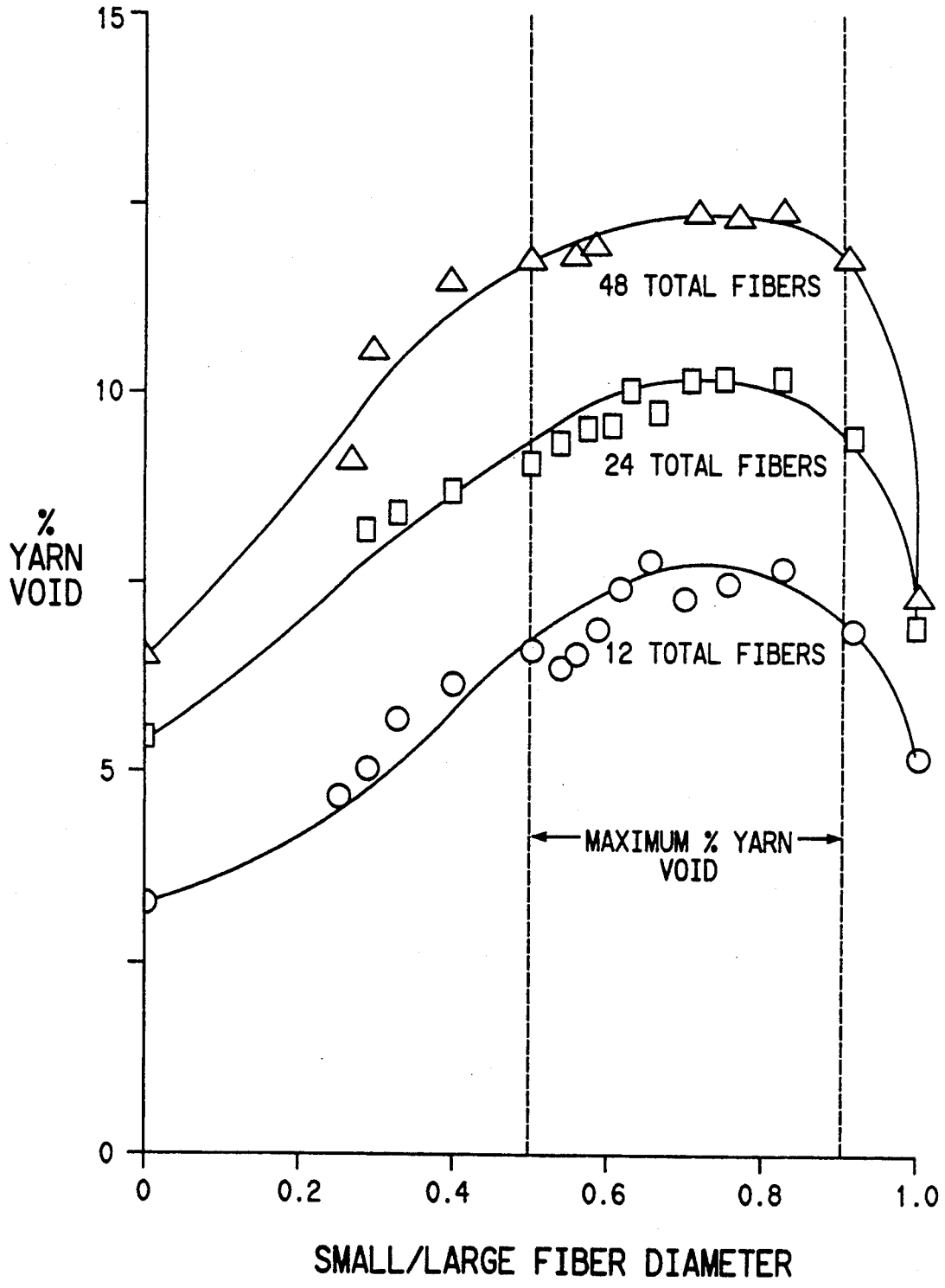
FIG. 6 is a graph plotting % yarn void against the (ratio of) small/large fiber diameter for three yarn cross-sections composed of 48, 24 and 12 total fibers, as described hereinafter.
Figure 7:
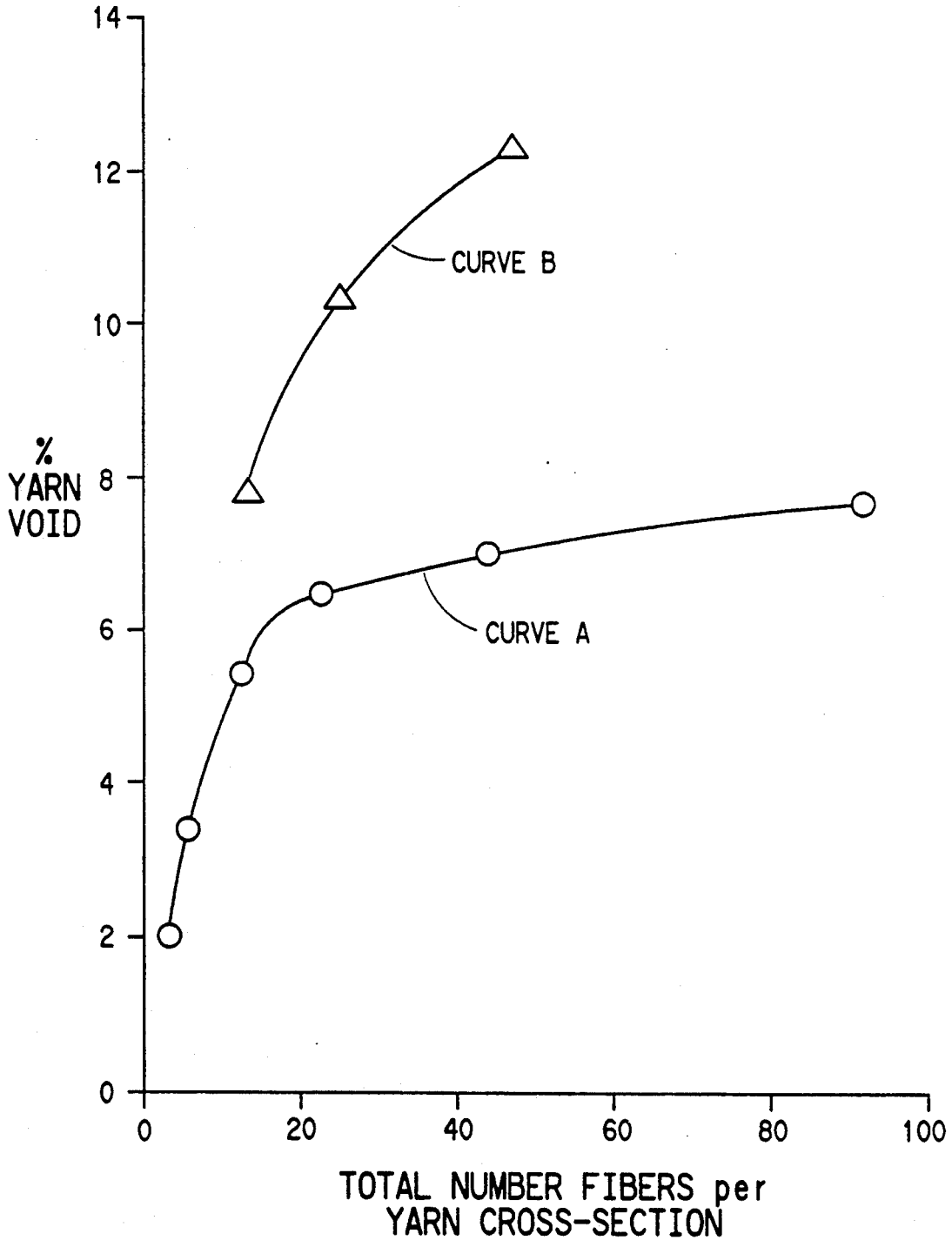
FIG. 7 is a graph plotting % yarn void agains total number of fibers per yarn cross-section, as described hereinafter.

The degree of mixing of the fibers of mixed denier in the cross-section of such yarn as represented in FIG. 1 can be measured by a DFI test. DFI means degree of filament intermingling, and is described, in relation to continuous filament yarns (referred to as heather yarns) in Reese U.S. Pat. No. 3,593,513, in the following words, referring to FIGS. 6 and 7 of the Reese patent:

The degree of filament intermingling (hereafter DFI) is measured in the following manner: The yarn to be analyzed is either wound about a flat metal holder about the size of a standard playing card or it is woven to a taffeta fabric, or both. It is then scoured and, in the case of the fabric, heat set. The sample is then dyed to produce a mixed-color appearance. An end is then cut to expose its transverse cross section, care being taken not to disturb the positions of the filaments in the yarn bundle. The cross section is photographed and the photograph enlarged. The enlargement will thus be similar to FIGS. 6 and 7 of the drawings; FIG. 6 showing the cross section of a 46 filament yarn and FIG. 7 showing the cross section of a 56 filament yarn. The number of filaments ($n_1$) of the first group, e.g. black filaments, which touch, or which would touch by mere straight line translation, filaments of the second group, e.g., white filaments, is counted. The number of filaments of the second group ($n_2$) which touch or which would touch by simple straight line translation, the filaments of the first group is then counted. The DFI is calculated by the formula:

$$DFI\,(\%) = 50\left(\frac{n_1}{n_{1t}} + \frac{n_1}{n_{2t}}\right)$$

wherein $n_{1t}$ is the total number of filaments in the first group and $n_{2t}$ is the total number of filaments in the second group. Thus the yarn of FIG. 6 has a DFI of about 95 percent while the yarn of FIG. 7 has a DFI of approximately 56 percent. Alternately, if the two types of filaments can be distinguished without dyeing, then the dyeing step can be omitted. Thus yarns with variable luster, or with one group pigmented (colored) differently from the other, dyeing is not needed to distinguish the filaments and can be omitted. Similarly, yarns from polymer with different melting points can be distinguished without dyeing by heating the cross sections until the lower melting filaments sinter sufficiently to distinguish from the other type of filaments.

The same general technique, i.e. measurement of intermingling, is applicable herein to polyester staple fiber in a spun yarn. However, unlike heather continuous filament yarns, for which the filaments must be colored to distinguish them, the DFI relates to the degree of intermingling of fibers of differing deniers. Since the fiber of smaller denier is distinctly smaller (about half the size) of the fiber of larger denier, the difference will be immediately apparent, and there is no need to color the fibers. As will be appreciated from looking at FIG. 1, even a comparatively random degree of mixing provides a significant increase in the interstitial spaces, because the presence of fibers of significantly differing deniers prevents close packing, even if the fibers of one denier tend to pack together to some extent. What is most significant is that the use of fibers of mixed denier has shown a perceptible increase in comfort properties in wholly polyester fabrics. Possibly, the improvement may be because of the inevitable packing together of the prior art polyester fibers, of uniform denier, especially when they are subjected to the lateral pressures involved in spinning (twisting) into yarns, and in subsequent fabric formation.

The advantages of using the intimate mixtures of polyester staple fibers according to the invention are better described hereinafter in relation to the Examples. These advantages shown hitherto are significantly surprising, especially if such advantages can be confirmed by perceived comfort improvements in fabrics prepared from yarns prepared from blends with cotton. Because cotton is a natural product, cotton is itself a variable product, in the sense that there is no uniform length, diameter, or surface, and in this respect, quite apart from chemical differences, there are significant physical differences between a natural fiber, such as cotton, and a synthetic fiber, where every effort has generally been made by a synthetic fiber manufacturer to achieve uniformity to the extent of practical identity between different fibers. Because of the significant content of cotton (which is necessarily of varying dimensions) it would be extremely surprising if garments formed from yarns of blends of cotton with mixed denier polyester staple according to the invention should provide confirmed comfort advantages, as compared with garments prepared from prior art blends, involving only single nominal denier polyester staple fiber.

Although the reasons for these advantages are not fully understood, and the invention is not limited by any theory of operation, the following speculations may be of assistance. Conventionally, most polyester staple has been of round cross section. This is because a round cross section has proven, so far, to be the most economical to produce, and cost has been an extremely important consideration in the manufacture of polyester staple fiber, which has long been a commodity, and has been available in abundant quantities (generally in excess of demand) in many industrial countries, and has been easily transportable at relatively low costs from countries where costs of manufacture are already low, and are often subsidized so as to facilitate the export of polyester staple fiber and improve the balance of trade of the country of manufacture as part of that country's government policy. As already indicated, conventionally, polyester staple fiber is manufactured from polyester filament tow which, in turn, is generally prepared by assembly from individual bundles of polyester continuous filaments formed by spinning in individual cells, in a manner comparable to that conventionally used for polyester continuous filament yarns. These bundles of filaments are assembled into a tow, which may amount to some million or so polyester filaments. The filaments in these bundles may have some cohesion, depending on their history and mode of preparation, possibly resulting from the application of finish to the freshly-spun bundle, from any other reason for the filaments in the initial bundle to stick together, and from any slight degree of twist that may be introduced as the filament bundle is advanced past various rolls and guides. Consequently, depending on the particular history of making the individual bundles and the tow, and on the particular conditions of mixing, any such subsequent mixing or blending operation may appear to achieve intimate admixture with cotton, but may not achieve a degree of mixing of the individual fibers as great as can be obtained by cospinning or spinning on the same machine according to the preferred process of the invention. If filaments of the same denier and round cross section are closely packed into small bundles, it is believed that certain results may follow, such as reduced air permeability between the fibers, difficulties in dyeing, reduced moisture transport (wicking action) and other characteristics that may, in retrospect, also be attributable to the close packing of the individual filaments. In contrast, if the filaments are of distinctly different deniers, this close packing arrangement becomes more difficult, if not impossible, and probably accounts for improved air permeability, ease of access of dye molecules, moisture transport, for example, and also an ability of the filaments to move past each other readily and take up different positions, which could be of great advantage in a comfort sense and in improving processability of the staple fibers and possibly even of precursor tows. These results and consequent advantages may be enhanced by varying the cross section of the individual filaments, in addition to varying the denier, and this is why, from technical considerations, different cross sections for the polyester staple fiber and precursor filaments may be preferred, as well as mixed deniers. However, some cross-sections (such as certain trilobal filaments) may tend to give a harsher feel in fabrics, whereas a scalloped-oval cross-section or other less harsh configuration may be preferred.

For convenience, the discussion herein is directed to mixtures of fibers of two different deniers, with the perceived objective being to minimize the possibility of close packing, and maximize the spaces between adjacent fibers. Taking this simple combination of two different deniers, from theoretical considerations, we have calculated that the percentage of space between such closely packed fibers increases through a maximum, at a ratio of small to large diameters of about 0.7, corresponding to a small to large denier ratio of about 0.5. It will be understood that essentially the same effect can, however, be obtained with different diameter or denier ratios within a range on either side of this approximate optimum. For instance, we have calculated that almost as much benefit can be obtained when the small to large fiber diameter ratio is from 0.5 to 0.9, corresponding to a denier ratio of 0.25 to 0.8. In other words, it is believed possible to obtain essentially as much advantage by providing mixed denier staple of such small to large denier ratios, and it is not necessary to provide mixed denier fibers only in the exact 0.5 ratio of small to large denier.

Calculations were done as follows, and are illustrated in FIG. 6, for yarn cross-sections composed of 48, 24 and 12 total fibers. The objective was to model a yarn cross section and determine the effect of mixing round fibers having different diameters on the yarn internal void space. A Video Intensity and Shape Analyzer was programmed to:

Accept diameter ratios and number of circles input.

Randomly select a small or a large circle and place it at the center of the video screen.

Continue selecting small or large circles at random and placing them tangent in a close packed array until all input circles had been used.

Compute the percent void space between circles when the last circle had been put in place.

As can be seen from FIG. 6, for round fibers, 50% of one denier and 50% of another, randomly-distributed, and close-packed, the yarn void space was greatest for a small to large diameter ratio range of 0.5 to 0.9. This diameter ratio range is equivalent to a small to large denier ratio range of 0.25 to 0.8 for polyester.

FIG. 7 shows that the advantage in larger % yarn void for mixed denier yarn over uniform denier yarn increases with the number of fibers in the cross-section of the yarn. Curve A shows a plot of the yarn void against the total number of fibers per conventional yarn cross-section, where all the fibers are of the same denier, i.e., a yarn of fibers of uniform denier. It will be noted that the % yarn void increases sharply at first, up to about 6% yarn void, then, even by about 20 fibers per yarn cross-section, has flattened out and is still below 8% yarn void even above 80 fibers per yarn cross-section. Curve B is a similar plot, but for yarns according to the invention, where the denier of half the fibers is 2X the denier of the other half of the fibers. For Curve B, not only is the lowest % yarn void value plotted about 8%, for a yarn cross-section of less than 20 fibers, but the increase in % yarn void is much steeper than for Curve A. In other words, the advantage of mixed denier yarns according to the invention over conventional single denier yarns increases with the number of fibers per yarn cross-section. This is why yarns of more than 50 fibers and preferably more than 100 fibers are preferred.

As many textile yarns have significantly more than 48 fibers per yarn cross-section, a computer program was used (because of limitations in the above program) to make the necessary geometric computations for determining % yarn void sequentially as filaments were added by random selection from the large or small denier sets to the yarn cross-section in a close-packed array. Results from the computer program were in excellent agreement with those from the Video Intensity and Shape Analyzer program mentioned above.

A 25 cotton count yarn composed of fibers having an average denier of 1.5 has 142 fibers in an average cross-section. For such a yarn having sufficient twist to produce hexagonal close packing, the % yarn void was computed to be about 8% when all of the fibers were 1.5 denier and about 14% when half were 1 denier and the remaining half 2 denier. Thus this mixed denier yarn had about a 75% advantage in % yarn void.

The above calculations have been made on the basis that essentially only 2 fiber diameters are involved, which would be the case in a wholly polyester yarn of only 2 deniers mixed together. When blended with cotton, however, assuming that the polyester blend is of, for example, 1½ nominal denier, i.e., the lower denier fibers are of average denier about 1, and the higher denier fibers are of average denier about 2, and that the polyester is blended with cotton also of matching average denier 1½ then the resulting yarn will involve such cotton fibers of this intermediate average denier, which may have the effect of reducing the void content, so that it may be advantageous to further widen the difference between the average deniers of the polyester fibers, so as to increase the void content in the resulting blend, because it is this blend with cotton, rather than the polyester blend of mixed deniers, that will be used in the yarns, and so in the ultimate garments and fabrics that must be worn.

For convenience, about equal numbers of small and large denier fibers have been used, but this is not essential, especially if mixed cross-sections are used in addition to mixed deniers, bearing in mind the perceived objective of maximizing spaces between fibers, and minimizing close packing. Indeed, from a theoretical standpoint, in a yarn of some 140 fibers in cross-section, a major improvement in loose packing can be obtained, in theory, from arranging only a relatively small number of fibers of different denier, provided they are strategically located so as to maximize the packing dislocation, i.e. prevent close packing. However, the use of minimally small proportions of fibers of different denier will not necessarily achieve uniform advantages, and so it is preferred to use more equal proportions and obtain more reliable results. This will also depend on the number of fibers, since the use of mixed deniers will probably provide little difference in the packing of fibers in yarns having only a very small number of fibers in each cross-section.

Figure 3:
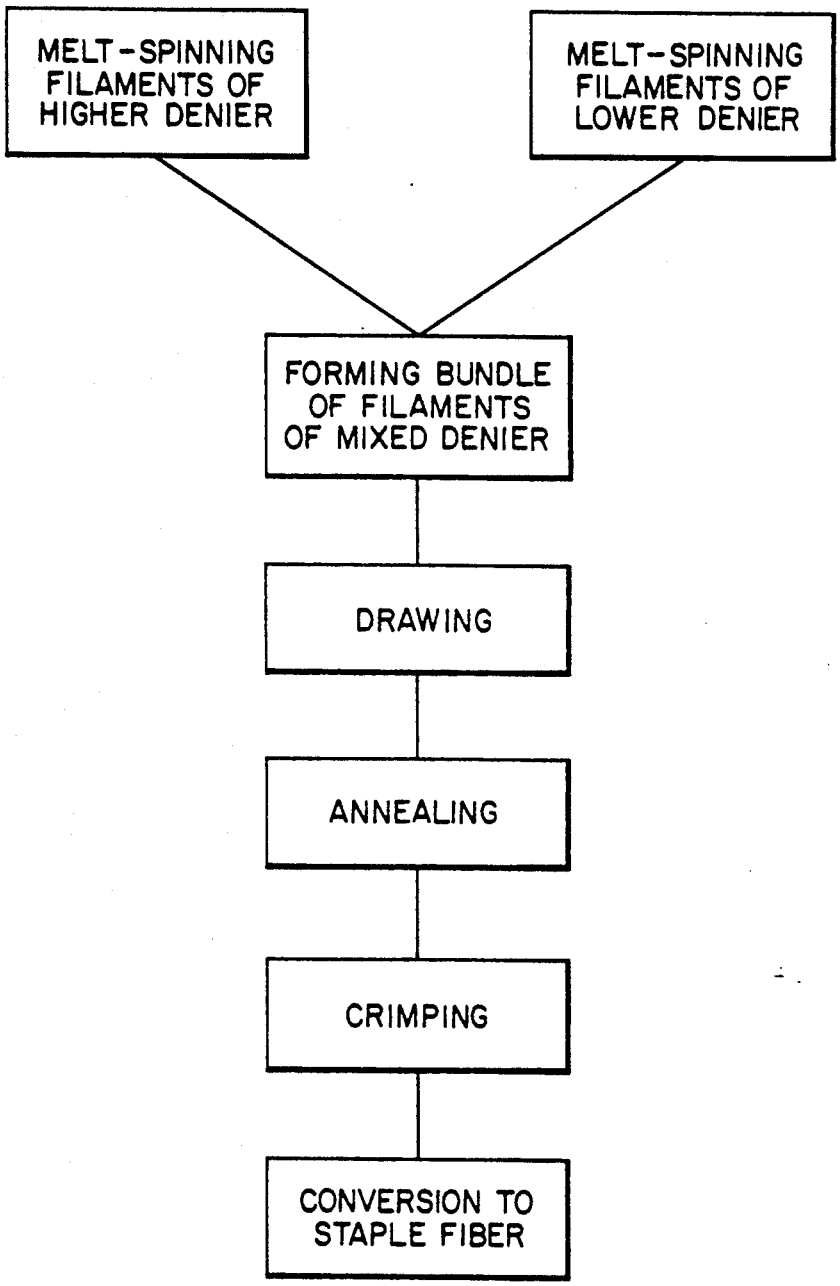
FIG. 3 is a block diagram to show typical process steps by which a staple fiber blend of the invention may be prepared.

A process for preparing the blends according to the invention will be described with reference to FIG. 3, which is a block diagram showing a typical processing sequence that may be used. Thus, the first stage is to melt spin the filaments of higher denier and the filaments of lower denier and form them into a bundle of filaments of mixed denier, and this will be described in further detail. However, in other respects, the preparation of the staple fiber may be conventional. The precise details will generally depend on the intended use of the polyester fiber and, accordingly, the properties desired. For instance, for textile processing, especially spinning (twisting) to form spun yarns, polyester tows are conventionally crimped mechanically, e.g. by a stuffer-box. For some purposes, especially where strength is desirable, the tows are annealed. It is important to reduce the shrinkage of the polyester filaments, and this is done conventionally, by relaxing without restraint, or during an annealing process in which the filaments are maintained under tension. To provide filaments (and subsequently staple fiber) of adequately low shrinkage, it is generally desirable to reduce the boil-off shrinkage to about 1% or less, and especially to avoid variations in shrinkage, such as tend to occur with higher shrinkage fibers, but boil-off shrinkages of less than 2%, (or even up to 3%, in some instances) may also be used. However, since textile fabrics are generally heat-set, at much higher temperatures than 100° C. (boil-off temperature), it is generally more useful to know the dry heat shrinkage, measured at typical or maximum likely heat-setting temperatures. For the present application, dry heat shrinkage is measured at 196° C. It is also important to avoid high shrinkage tensions, as indicated. It is believed that most polyester staple fiber for textile use is prepared from filaments that have been withdrawn from the spinneret at relatively low speeds, followed by a drawing operation to increase the orientation and crystallinity. However, it has been known for many years, e.g. as disclosed by Hebeler, U.S. Pat. No. 2,604,667, that somewhat similar properties can be obtained, without drawing, merely by withdrawing polyester filaments at extremely high speeds, although such a process requires high capital investment. Conventionally, an appropriate finish is applied to the polyester filaments to facilitate further processing, and the particular finish selected will depend on the end use intended. For some end use applications, a transient finish is desired, i.e. one that is easily removed, e.g. by washing. For other applications, it may be desirable to apply a permanent finish, or a combination of a permanent and transient finish, according to the desired end use.

Figure 4:
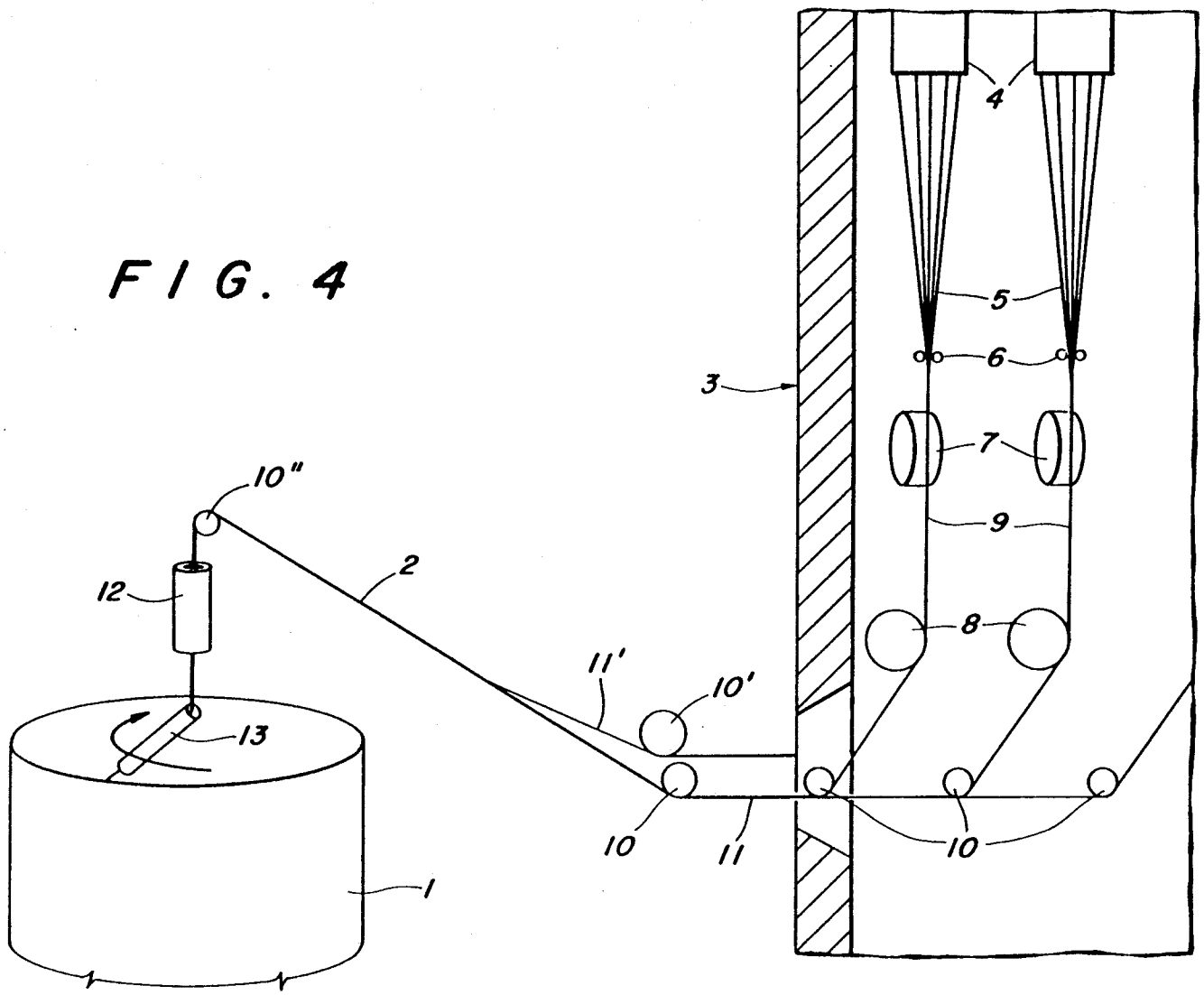
FIG. 4 shows schematically a part of a spinning machine with a piddler can, whereby a bundle of filaments of mixed denier according to the invention may be prepared.

The preparation of an intimate mixture of filaments of mixed denier in the same bundle by spinning on the same spinning machine will now be described in greater detail with reference to FIG. 4, which represents part of a conventional spinning machine providing a bundle of polyester continuous filaments which are collected in a piddler can, and which can be adapted for preparing a tow of filaments of mixed denier for use according to the present invention. The piddler can 1 is shown on the left and is fed with a large bundle 2 of filaments obtained from the spinning machine 3 on the right of the Figure. At the top are shown a series of spinnerets 4, stretching away to the right, it being understood that only part of the spinning machine is shown, with only two of the spinnerets, but it being conventional to arrange a much larger number of spinnerets in a bank on either side of the spinning machine, only one side of which is shown in the Figure. Molten polymer is spun through orifices in each spinneret 4 to form filaments 5 which are cooled by air conventionally by means not shown, and are converged by passing between guides 6, before the solid filaments pass a finish applicator, shown as a roll 7, before contacting feed rolls 8, which are driven at a speed (the withdrawal speed, or spinning speed) which determines the orientation of the freshly-extruded filaments. Thereafter, each filament bundle 9 from each individual spinneret 4, or spinning position, or spinning cell, is advanced by rolling guides 10 and combined with bundles from the other spinning positions to form larger bundle 11 that emerges from the front of the spinning machine and is combined with a similar bundle 11' that has been provided from spinnerets and spinning positions (not shown) on the back of the spinning machine and advanced by rolling guides 10'. Thus the larger bundles 11 and 11' are superimposed and so combined into large bundle 2 which is further advanced by rolling guide or guides 10'' and fed into air jet 12 and through lay-down spout 13 into piddler can 1, which is used for transporting the freshly-spun filaments in large bundle 2 to the next stage. The next stage is conventionally a drawing machine, assuming that large bundle 2 consists of conventional undrawn polyester filaments, which are subjected to the conventional steps of drawing, annealing if desired, crimping, relaxing and converting to staple fiber. Hitherto, the process described has been conventional.

Such a process can easily be adapted for preparing the mixed denier products of the invention in several ways. It is believed that the most uniform mixing can be achieved by cospinning, i.e. by spinning mixed denier filaments from the same spinneret 4 through capillaries of differing size and/or throughput into the same spinning cell, or spinning position, and collecting these filaments of different deniers into the same bundle 9 at the bottom of each spinning position, and then collecting several such bundles of mixed denier filaments forwarding and processing them appropriately. Such a process may be particularly desirable if the bundles 9 are provided with significant bundle integrity, e.g. by application of twist and/or such amount and/or type of finish, or for small tows, e.g. for conversion by stretch-breaking.

However, provided precautions are taken, we have found that very satisfactory results have been obtained by spinning filaments of uniform denier from each spinneret 4 and collecting them in the same bundle 9 at the bottom of each spinning position, and then combining such bundle 9 of filaments of uniform denier with other bundles of filaments of different denier into a large bundle of filaments of mixed denier. In other words, different spinning positions on the same spinning machine will each spin bundles 9 of filaments of uniform denier, but because the different spinnerets 4 are spinning filaments of different denier, the final bundle 2, and possibly the larger bundles 11 and 11', contain filaments of mixed denier. It is important to avoid the individual bundles 9 having too much bundle integrity such as will inhibit forming an intimate mixture of mixed denier during later processing. Thus, it is important to avoid excessive interlacing, or bundle twist, or excessive coating of finish, as will inhibit later intimate mixing.

If the above theory is correct, namely that mixed denier fibers provide more comfort in garments because they do not pack so closely in spun yarns as single denier fibers, then this advantage will be obtained, regardless of the time of mixing provided the distribution of fibers of different deniers is achieved (e.g. by obtaining a preferred DFI of at least about 90%) in the spun yarns in the ultimate garments. Thus, in order to obtain this objective, it may not prove necessary to mix the filaments in the precursor tows, as described above for the preferred process. Nevertheless, this process is preferred because of its effectiveness and its economy. However, alternatively, mixing could be achieved during processing of the staple fiber, preferably by cutter blending tows containing filaments of different deniers so as to produce a mixed denier staple, or at a convenient later stage. It will be understood that the normal staple operations are intended to mix the various fibers together, and to improve the degree of mixing of whatever materials are fed. For instance, if slivers of fibers of differing denier are fed into an early stage of a multistage drafting operation, considerable mixing will be achieved in the later stages and in the resulting spun yarns. The drafting conditions should not be such as to segregate the different deniers to an undesirable extent.

The fibers in spun yarns must be twisted tightly together in order to maintain the integrity of the yarn. In contrast in filament yarns, close packing is not necessary to maintain the integrity of the yarns. So it can be understood that the need for interstitial voids between closely packed fibers is correspondingly greater if, indeed, such interstitial voids or passages promote greater comfort for the wearer of the garments. Thus, it is believed that the garments from spun yarns containing mixed denier fibers are softer and provide more comfort because of the open space and loose ends, which are believed to provide soft, dry, cool, and airy aesthetics, and more breathability. It is possible that the mixture of deniers also gives better aesthetics for reasons that are not connected (or only indirectly connected) with the greater interstitial spacing, for instance the loose ends that inevitably protrude from the surface of a spun yarn and garment thereof may provide a more pleasant texture, because of the mixture of deniers. The interstitial spacing may, however, be responsible for a greater ability of the fibers to move and flex, and this could be responsible, in part, for any greater feeling of comfort in the garments.

The invention is further illustrated in the following Example, which describes the preparation of spun yarns from 100% polyester staple of boil-off shrinkage about 1%, and of low dry heat shrinkage (196° C.) about 5.5%, and also from blends of such polyester staple with other fibers.

EXAMPLE

An intimate mixture of approximately equal numbers of low pilling polyester staple fiber (relative viscosity 15.4, LRV 11.5) of about 1 and about 2 dpf was obtained by a process, as described with reference to FIG. 4, involving conventionally melt-spinning to form a bundle of filaments, combining several bundles to form a large bundle, i.e. a small tow, drawing/annealing and crimping the tow, and converting the tow to staple fiber by cutting, except that the large bundle (tow) contained intimately mixed filaments of different dpf made by spinning through orifices and capillaries with different throughput on the same spinning machine. The orifices were circular to provide filaments of round cross section. The smaller filaments (spun denier 2.72, natural draw ratio 1.68) were spun on one side, on 18 positions, each having 2400 orifices of diameter 15×30 mil (about 0.38×76 mm) under a pack pressure of 1500 psig at a throughput of 0.0625 lbs. per hour. The larger filaments (spun denier 4.89, natural draw ratio 1.69) were spun through similar orifices, but under a pack pressure of 1900 psig at a throughput of 0.1195 lbs. per hour, on the other side, on 24 positions, each having 1590 orifices. All these filaments were spun at a withdrawal speed of 1,800 ypm. The tow, amounting to about 80,000 filaments, was drawn at a draw ratio of 3.1X, crimped to give drawn filaments of 9 crimps per inch and crimp take-up 31.5, and cut to a cut length of 1½ inches, to give staple fiber with tenacity of 3.4 g/d, a dry heat shrinkage that had been reduced to a value of about 5.5%, with a finish level of 0.07% by weight of the filaments. The nominal denier was 1.5, but about half the filaments were of 1 denier and the other half of 2 denier.

It was surprising that it was possible to spin on the same spinning machine undrawn filaments of different denier that could be assembled into a tow and then be drawn satisfactorily at the same draw ratio in the same tow, i.e. to give satisfactory drawn filaments and eventually cut fiber (of intentionally significantly different denier). In other words, it was surprising that it was possible to spin undrawn filaments of substantially the same natural draw ratio, but of significantly different denier, on the same spinning machine. These filaments and cut fiber have also shown good processability through to spun yarns, and eventually fabrics and garments, which may be a result of their relatively sharply defined denier distribution, as shown hereinafter in FIG. 5 for Yarn A. The tensile properties of the drawn filaments (and cut fibers) were significantly different, the tenacities of the smaller denier filaments being significantly higher than those of the filaments of higher denier.

The staple fiber was formed into yarns of singles (cotton) count 16 (corresponding to about 330 denier, or about 220 fibers of nominal denier 1½ and knit by an outside evaluator into fabrics which were tested in comparison with comparable fabrics, except from a competitive commercial polyester staple fiber (Fabric K). The details are shown in Table 1.

TABLE 1

| Parameter | Yarn Types A | K |
|---|---|---|
| Fabric Wt., oz./sq. yd. | 4.93 | 5.36 |
| Fabric Count, w × c | 25 × 27 | 26 × 26 |
| Fabric Thickness, mil | 19.0 | 20.0 |
| Moisture Vapor, gm./sq. m./24 hrs. | 987.3 | 953.0 |
| Air Permeability-Dry, cu. ft./sq. ft./min. | 576.4 | 479.3 |
| Air Permeability-Wet, cu. ft./sq. ft./min. | 613.0 | 508.5 |
| Random Pilling, | | |
| 0 min. | 4.9 | 4.9 |
| 3 min. | 4.3 | 2.9 |
| 5 min. | 3.1 | 1.9 |
| 10 min. | 2.1 | 1.3 |
| 20 min. | 1.5 | 1.0 |
| 30 min. | 1.2 | 1.0 |
| Cover/Thickness | 4.53 | 4.40 |
| Tenacity, gm/den | 1.75 | 2.39 |
| Elongation, % | 17.30 | 27.50 |
| K/S @ 460 nm | 0.0061 | 0.0053 |

Fabric A prepared from staple fiber of the invention showed the following differences, which translate into a significant overall advantage, as rated by the outside evaluator:

1. 17% deeper dyed in competitive dyeing;
2. 20% higher air-permeability in dry fabric, and 12% higher in wet fabric;
3. 4% higher moisture vapor transport;
4. 27% lower tenacity;
5. 37% lower elongation;
6. significantly superior pilling performance;
7. 3% higher cover per thickness.

The improved results obtained with the polyester staple fiber of the invention prepared in this Example over the prior art fiber are believed to result from the mixed denier feature, which may provide more open space between the tightly packed fibers, and possibly other advantages, which cannot yet be fully explained, and are not yet therefore understood.

The distribution of the deniers in representative samples of staple fiber comprising yarns A and K was counted, by taking 200 such staple fibers from each yarn, measuring their deniers and plotting the frequency of such deniers as histograms that are shown in FIG. 5 of the accompanying drawings. Thus, the histogram for yarn K, at the bottom, is typical in that it monomodal, i.e. has a distribution about a single peak at the nominal denier of about 1.5, whereas the histogram for yarn A is bimodal, i.e. has distribution about two separate peaks at the approximate nominal deniers of the two component fibers of about 1 and about 2.

These histograms seem to indicate that the significant advantages in fabrics of mixed denier yarn A over yarn K may not result entirely or directly only from the fact that fibers of mixed denier do not pack together so closely, because the variation in denier for the fibers sampled from yarn K (from a minimum of about 1 dpf to a maximum of more than 2 dpf) is significant enough in theory to allow for loose packing unless the fibers of similar denier in yarn K happen to or tend to congregate together in practice.

A further comparison is made by making spun yarn of 27/1 cc from 100% of the same mixed denier yarn A, and from 50/50 polyester/cotton blends, and knitting 18-cut interlock fabrics therefrom and comparing with similar fabrics from a commercial staple fiber B (of the same polymer as used for yarn A) and from a commercial competitive staple fiber C, both of uniform denier 1.5. The fabrics were all Jawatex scoured at 205° F., pressure dyed, dried, Tubetex steamed twice and heat set at 350° F. for 1 minute. No resins or softeners were used. The breathability of these fabrics was tested by measuring their air permeability in cfm (average cubic feet per minute), for both the 100% polyester and the blends. The results are shown in Table 2.

TABLE 2

| Sample | A | B | C |
|---|---|---|---|
| Air Permeability in CFM | | | |
| 100% Polyester | 393 | 371 | 363 |
| 50/50 blend | 300 | 291 | 237 |

These results show an improvement in air permeability for Sample A (mixed denier staple of my invention) over two commercial fibers of the same nominal denier, but of uniform denier. The improvement is significant, and is shown both for 100% polyester and for 50/50 blends with cotton. Interestingly, the air permeability for the blends is inferior to that for the 100% polyester, and the difference for A and C, at least, is far greater in the blend than for the 100% polyester, which seems to indicate that any speculation based on theoretical calculations of spacing between fibers may not be sufficient to account for the differences obtained in practice.

Similar yarns of other cotton counts can be made, and formed into fabrics and garments, from 100% polyester and/or blends containing various percentages of other fibers, such as cotton. An advantage of the perception that the mixed denier staple fiber provides better perceived comfort, is that the proportion of polyester in such blends can be improved over that preferred today by the wearer, e.g. back to 60/40 polyester-cotton, or even higher, e.g. to 75/25, or 80/20 or 100% polyester. The cut length of the polyester has generally been 1½ inches to match the average length of the cotton. Conventionally, cut lengths range from about 1 to about 3 inches. The denier of the polyester staple has conventionally matched the cut length approximately, i.e. a 1½ nominal denier for a cut length of 1½ inches. Using mixed denier polyester staple according to the invention, therefore, a mixed denier (1 and 2 denier) blend would match 1½ inches in cut length, as in the Example, although use of the mixed deniers may enable some variation in this hitherto-accepted rule of thumb. Thus nominal deniers of up to about 3 (mixed deniers of about 2 and about 4 denier) and generally down to about 1 (mixed deniers to about ¾ and about 1½) can be expected to be used, although there has been a tendency to use finer deniers in recent years, and this could be of advantage, e.g. in pilling performance. Furthermore, as indicated, especially when blending with cotton, there may be an advantage in widening the difference between the average deniers of the polyester fibers beyond the values indicated.

As for shrinkage, a uniform low boil-off shrinkage is important, as indicated. A boil-off shrinkage of about 1% or less is especially desirable. A low dry heat shrinkage is also desirable. The fiber used in the Example has given very good results, with a dry heat shrinkage of about 5.5%, but it will be understood that the dry heat shrinkage need not be precisely this value. To indicate the distinction from the fibers used by Wada, referred to above, measurements have recently been made on mixed denier fiber according to the invention of dry heat shrinkage 6.0%, and the boil-off shrinkage was found to be about 1%, and the shrinkage tensions (in mg/den) were found to be 2, 5 and 9 at 120° C., 160° C. and 200° C., respectively. Studies indicate that the fiber of the Example would have had somewhat better (i.e. lower figures), whereas the fibers of Wada Example 9, said to be of boil-off shrinkage 3%, would be expected to be of correspondingly higher dry heat shrinkage, such as 8.5%, and shrinkage tensions of 8, 20 and 29 mg/den at 120° C., 160° C. and 190° C,. respectively. As indicated, a low shrinkage tension is particularly desirable.

The invention has been described hereinbefore with particular reference to yarns and other articles consisting of polyester staple fiber of mixed denier prepared from polytethylene terephthalate), which is used commercially on a very large scale. Other polyester polymers may be used alternatively, or in addition, of course, e.g. cationic-dyeable polyesters, such as are already used commercially, or other copolymers that are mentioned in the literature. If desired, the polyester may include ingredients and/or additives, as is conventional, e.g. a content of delustrant, such as titanium dioxide, and/or be treated so as to modify the surface or other characteristics, as desired, to improve the properties of the substrate polyester during filament formation or subsequently, e.g. in fabric form. Such changes or modifications in the nature of the polyester polymer do not affect the essence of the invention, which is based on the intentional use of mixed denier staple instead of uniform denier staple to form the spun yarns.

I claim:

1. A spun textile yarn consisting essentially of a blend of intimately mixed polyester staple fibers of low shrinkage, wherein the polyester fibers are uniformly the same color, of boil-off shrinkage about 1% or less, of uniform cut length about 1 to 3 inches, and of average denier up to about 3 but consisting essentially of polyester fibers of larger denier randomly mixed with polyester fibers of smaller denier, the degree of filament intermingling (DFI) being at least about 90%, the larger denier being about twice the smaller denier.

2. A spun textile yarn consisting essentially of an intimately mixed blend of polyester staple fibers with fibers other than polyester fibers, wherein the polyester fibers are uniformly the same color, of boil-off shrinkage about 1% or less, of uniform cut length about 1 to about 3 inches, and of average denier up to about 3 but consisting essentially of polyester fibers of larger denier randomly mixed with polyester fibers of smaller denier, the degree of filament intermingling (DFI) being at least about 90%, the larger denier being about twice the smaller denier.

3. A spun textile yarn consisting essentially of an intimately mixed blend of polyester staple fibers with cotton fibers, wherein the polyester fibers are uniformly the same color, of boil-off shrinkage about 1% or less, of cut length about 1 to about 3 inches, and of average denier up to about 3 but consisting essentially of polyester fibers of larger denier randomly mixed with polyester fibers of smaller denier, the degree of filament intermingling (DFI) being at least about 90%, the larger denier being about twice the smaller denier.

4. A yarn according to any one of claims 1 to 3, wherein said polyester fibers are of dry heat shrinkage of the order of about 5.5%.

5. A yarn according to claim 4, wherein said polyester fibers are of mixed cross-sections.

6. A yarn according to any one of claims 1 to 3, wherein said polyester fibers are of mixed cross-sections.

* * * * *